US009486075B2

(12) United States Patent
Liu

(10) Patent No.: US 9,486,075 B2
(45) **Date of Patent: *Nov. 8, 2016**

(54) TOOL CABINET

(71) Applicant: Chia-Ming Liu, Dou-Lio (TW)

(72) Inventor: Chia-Ming Liu, Dou-Lio (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/843,825

(22) Filed: Sep. 2, 2015

(65) Prior Publication Data

US 2016/0198853 A1 Jul. 14, 2016

(30) Foreign Application Priority Data

Jan. 14, 2015 (CN) ..... 2015 2 0024419 U
Apr. 7, 2015 (CN) ..... 2015 2 0201061 U

(51) Int. Cl.

| | |
|---|---|
| ***A47B 46/00*** | (2006.01) |
| ***A47B 83/00*** | (2006.01) |
| ***A47B 9/20*** | (2006.01) |
| ***A47B 96/18*** | (2006.01) |
| ***B25H 3/02*** | (2006.01) |
| ***B25H 1/04*** | (2006.01) |
| *A47B 9/04* | (2006.01) |

(52) U.S. Cl.

CPC ..... *A47B 83/00* (2013.01); *A47B 9/20* (2013.01); *A47B 96/18* (2013.01); *B25H 1/04* (2013.01); *B25H 3/028* (2013.01); *A47B 2009/046* (2013.01)

(58) Field of Classification Search

CPC ..... A47B 9/04; A47B 13/00; A47B 37/00; A47B 45/00; A47B 46/00; A47B 83/00; A47B 96/18; A47B 17/02; A47B 9/20; B25H 1/04; B25H 3/028

USPC ..... 312/196, 223.2, 306, 312, 317.3, 319.5, 312/902; 108/59, 106, 147.19, 147

See application file for complete search history.

(56) References Cited

U.S. PATENT DOCUMENTS 654,922 A * 7/1900 Schipkowsky ..... A47B 17/036 312/196
742,118 A * 10/1903 Huddleston ..... A47B 31/00 108/17
1,099,521 A * 6/1914 Sprung ..... E05B 65/0003 312/196
1,247,590 A * 11/1917 Sprung ..... A47B 51/00 312/196
1,459,930 A * 6/1923 Riehle ..... B25H 1/04 144/285
2,019,455 A * 10/1935 Lehman ..... A47B 17/02 312/196

(Continued)

*Primary Examiner* — James O Hansen
(74) *Attorney, Agent, or Firm* — DLA Piper LLP (US)

(57) ABSTRACT

A tool cabinet includes a cabinet housing, drawers disposed in the cabinet housing, a working platform unit, two slide rails, two lifting units, a linkage unit, and a drive unit. The cabinet housing includes a top cover formed with a storage groove. The working platform unit has a platform member disposed above the top cover, and two extension members extending from the platform member through the top cover. The slide rails are disposed at the cabinet housing, engage respectively and slidably the extension, members, and are interconnected by the linkage unit. The drive unit is drivingly connected to one of the lifting units, and is operable to drive synchronised movements of the lifting units to move the working platform unit along the slide rails.

6 Claims, 6 Drawing Sheets

(56) References Cited

U.S. PATENT DOCUMENTS

| | | | | | |
|---|---|---|---|---|---|
| 2,931,685 | A * | 4/1960 | Harold | A47B 17/02 | 108/32 |
| 3,245,741 | A * | 4/1966 | Bartlett | A47B 17/02 | 312/196 |
| 3,297,387 | A * | 1/1967 | Parsons | A47B 29/00 | 112/217.1 |
| 4,627,364 | A * | 12/1986 | Klein | A47B 9/04 | 108/147 |
| 4,740,044 | A * | 4/1988 | Taylor | A47B 21/03 | 312/196 |
| 6,213,575 | B1 * | 4/2001 | Brin, Jr. | A47B 77/04 | 108/147 |
| 6,312,069 | B1 * | 11/2001 | Weng | A47B 9/06 | 108/147 |
| 8,033,620 | B2 * | 10/2011 | Retchloff | B25H 3/00 | 312/290 |
| 2002/0101139 | A1 * | 8/2002 | Lee | A47B 21/0073 | 312/196 |
| 2005/0046315 | A1 * | 3/2005 | Doane | A47B 17/02 | 312/196 |
| 2012/0025681 | A1 * | 2/2012 | Ton | A47B 46/00 | 312/309 |

* cited by examiner

TOOL CABINET

CROSS-REFERENCE TO RELATED APPLICATIONS

This application claims priorities of Chinese Application No. 201520024419.0, filed on Jan. 14, 2015, and Chinese Application No. 201520201061.4, filed on Apr. 7, 2015.

FIELD

The disclosure relates to a cabinet, more particularly to a tool cabinet.

BACKGROUND

A conventional tool cabinet includes a cabinet body and a plurality of drawers that are vertically stacked one above the other in the cabinet body. The conventional tool cabinet is used f or storing and systematizing items stored in the drawers, such as files, hand tools, power tools, and so on, in a ready-to-use manner. The top wall of the cabinet body also serves as a working table far a user to work thereon with the tools taken out from the drawers. However, since the height of the top wall is unadjustable, the conventional tool cabinet is not suitable for users of different heights to work on the top wall thereof, thereby resulting in possible inconvenience during use. Moreover, since the top wall of the cabinet body also serves as an extra storage spot for some items to be placed thereon while the top wall is not used as a working table, storage space of the conventional tool cabinet say be scarce when the top wall is in use.

SUMMARY

Therefore, the object of the disclosure is to provide a tool cabinet that can alleviate the drawbacks associated with the above-mentioned prior art.

Accordingly, a tool cabinet of the present invention includes a cabinet housing, a plurality of drawers, a working platforms unit, two slide rails, two lifting units, a linkage unit and a drive unit. The cabinet housing includes a top cover having a top surface that is forced with a storage groove. The drawers are movably disposed in the cabinet housing. The working platform unit has a platform member disposed above the top cover, and two extension members extending respectively and downwardly from two opposite ends of the platform member through the top cover. The slide rails are respectively disposed at opposite sides of the cabinet housing. The extension members engage respectively and slidably the slide rails. The lifting units are respectively and movably disposed at the opposite sides of the cabinet housing, and are connected to the working platform unit. The linkage unit interconnects the lifting units and synchronizes movement of the lifting units. The drive unit is drivingly connected to one of the lifting units, and is operable to drive synchronized movements of the lifting units to move the working platform unit along the slide rails between a lowered position, where the platform member is adjacent to the cabinet housing and closes the storage groove, and a lifted position, where the platform member is away from the cabinet housing.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
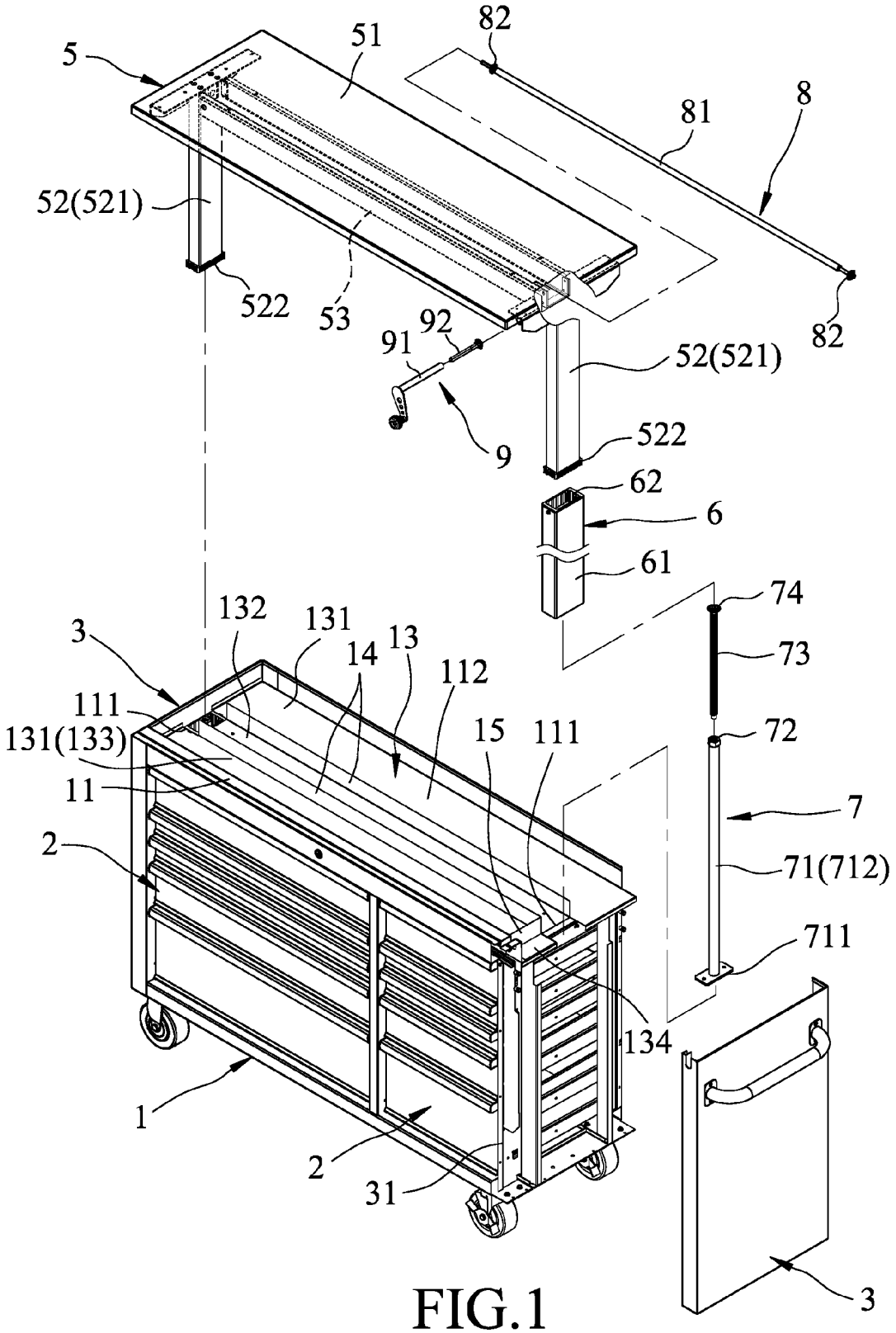
FIG. 1 is a fragmentary partly exploded perspective view of an embodiment of a tool cabinet according to the disclosure.

As shown in FIGS. 1 to 4, the embodiment of a tool cabinet according to the present disclosure includes a cabinet housing 1, a plurality of drawers 2, two sideboards 3, a working platform unit 5, two slide rails 6, two lifting units 7, a linkage unit 8 and a drive unit 9.

The cabinet housing 1 includes a top cover 11 that has a top surface forced with a storage groove 13. The storage groove 13 has a bottom end terminating at an end-defining surface 112 (i.e., the end-defining surface 112 defines a bottom end of the storage groove 13). The end-defining surface 112 is formed with two through holes 111. The cabinet housing 1 further includes two border plates 14 and a dividing plate 15. The border plates 14 are disposed in the storage groove 13 and divide the storage groove 13 into two main storage groove sections 131 and an intermediate groove section 132 that is disposed between the main storage groove sections 131. The dividing plate 15 is disposed in one of said main storage groove sections 131 and interconnects perpendicularly the border plates 14 to divide the one of the main storage groove sections 131 into a first storage subsection 133 and a second storage subsection 134.

The drawers 2 are movably disposed in the cabinet housing 1, and are arranged in two parallel rows.

The sideboards 3 are respectively coupled to two opposite sides of the cabinet housing 1. Each of the sideboards 3 cooperates with a respective one of the sides of the cabinet housing 1 to define a receiving space 31 (only one is visible in FIG. 4) therebetween.

The working platform unit 5 has a platform member 51 disposed above the top cover 11, two extension members 52 extending respectively and downwardly from two opposite ends of the platform member 51, and a hollow receiving member 53 disposed under and connected to the plat-form member 51, and interconnecting the extension members 52. Each of the extension members 52 has a main portion 521 that extends downwardly from a respective one of the two opposite ends of the platform member 51 and that has a rectangular cross-section, and an engaging portion 522 that surrounds and protrudes from a bottom end of the main portion 321.

The slide rails 6 are respectively disposed in the receiving spaces 31 which are at opposite sides of the cabinet housing 1, and respectively extend through the through holes 111. In this embodiment, each of the extension members 52 engages respectively, slidably and fittingly into the slide rails 6, Each of the slide rails 6 has a slide portion 61 that has a rectangular cross-section and that has an inner surface surrounding and contacting the main portion 521 of a respective one of the extension members 52, and an abutment portion 62 that is connected to a top end of the slide portion 61 and that surrounds and abuts against the main portion 521 of the respective one of the extension members 52 within the slide portion 61. In this embodiment, the abutment portions 62 of the slide rails 6 are respectively disposed in the through holes 111 and are flush with the end-defining surface 112.

Figure 4:
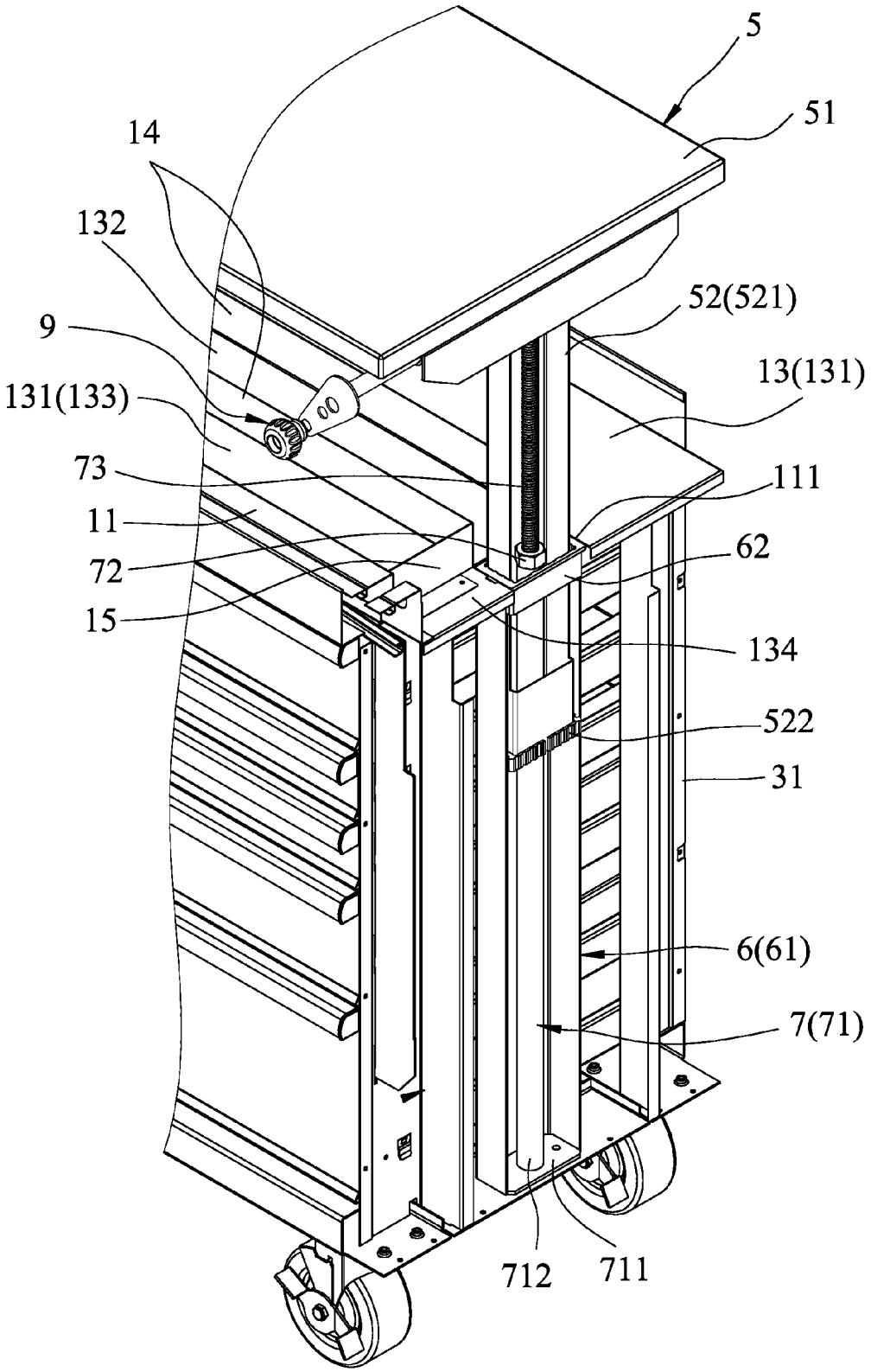
FIG. 4 is fragmentary perspective view of the embodiment.
Figure 5:
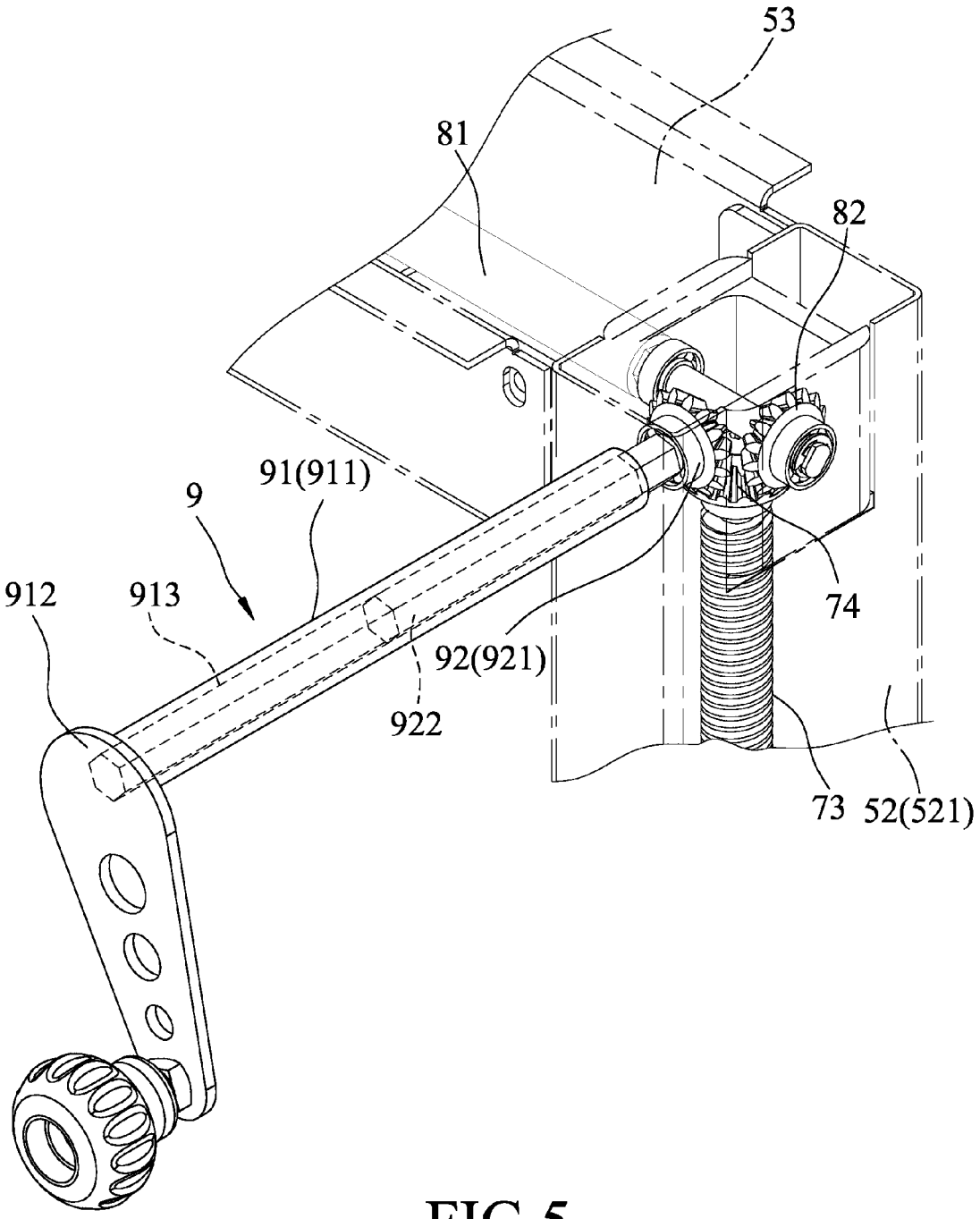
FIG. 5 is a fragmentary enlarged perspective view illustrating a drive unit, a lifting unit and a linkage unit of the embodiment.

As shown, in FIGS. 1, 4 and 5, the lifting units 7 are respectively and movably disposed in the receiving spaces 31 which are at opposite sides of the cabinet housing 1. Each of the lifting units 7 has a guide tube 71 that is disposed in a respective one of the slide rails 6, a nut 72 that is disposed on a top end of the guide tube 71, a threaded rod 73 that is threadedly connected to the nut 72 and that has a top end adjacent to the platform member 51 and an opposite end inserted telescopically into the guide tube 71, and a transmission bevel gear 74 that is fixedly disposed on the top end of the threaded rod 73. In this embodiment, the guide tube 71 of each of the lifting units 7 has a support portion 711 that is connected to the bottom end of the cabinet housing 1, and a tube portion 712 that extends upwardly from the support portion 711.

Figure 3:
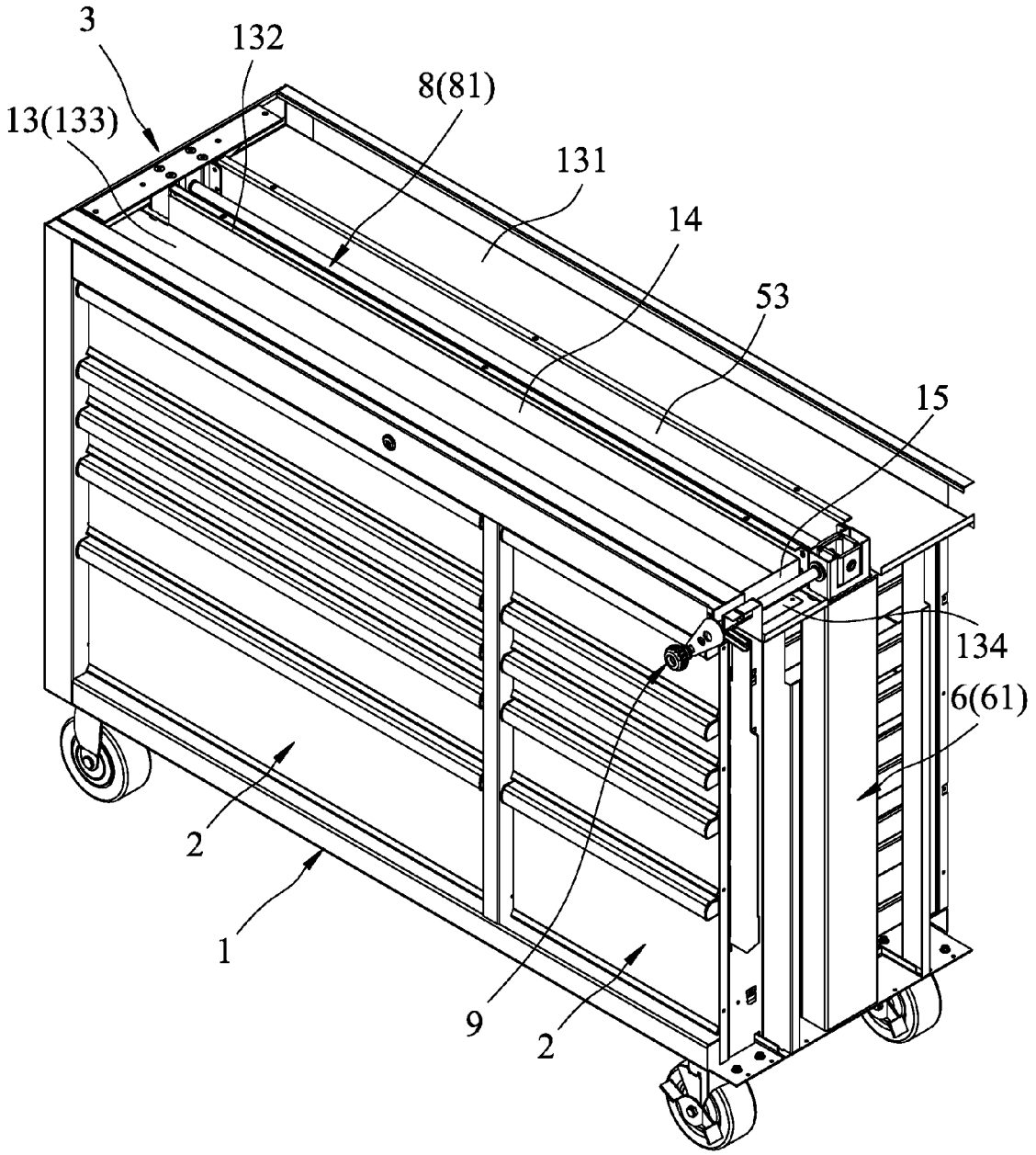
FIG. 3 is an assembled perspective view of the embodiment, illustrating the working platform unit when lowered downward to the top cover.

Referring to FIGS. 1, 3 and 5, the linkage unit 8 interconnects the lifting units 7 and synchronizes movement of the lifting units 7. In this embodiment, the linkage unit 8 includes a linkage rod 81 that is disposed in the hollow receiving member 53 of the working platform unit 5, that extends along a horizontal axis, and that is rotatable about the horizontal axis, and two linkage bevel gears 32 that are respectively connected to two opposite ends of the linkage rod 81 and that respectively mesh with the transmission bevel gears 74 of the fitting units 7.

The drive unit 9 is drivingly connected to one of the lifting units 7, and is operable to drive synchronised movements of the lifting units 7 to move the working platform 5 along the slide rails 6. In this embodiment, the drive unit 9 is disposed below the platform member 51 of the working platform unit 5, and includes a crank member 91 and a drive bevel gear 92 connected to the crank member 91. The crank member 91 has a rotatable connection portion 911 that is mounted to the working platform unit 5 and that has an end connected to the drive bevel gear 92, and a handle portion 912 that is connected to another end of the connecting portion 911 opposite to the drive bevel gear 92. In this embodiment, the rotatable connection portion 911 has a non-cylindrical elongated engaging space 913. The drive bevel gear 92 has a main gear segment 921 that meshes with the transmission bevel gear 74 of the one of the fitting units 7, and an engaging segment 922 that is connected co-axially to the main gear segment 921 and that engages removably, fittingly and co-rotatably the engaging space 913 of the rotatable connection portion 911. As such, the crank member 91 is connected to the linkage bevel gear 82 of a corresponding one of the linkage units 8 via the one of the lifting units 7, so that a user can hold and turn the handle portion 912 to rotate the connection portion 911 for synchronizing movements of the lifting units 7 to move the working platform unit 5 along the slide rails 6.

In order to move the working platform unit 5, the handle portion 912 is first turned to drive the connection portion 911 to rotate, so that the drive bevel gear 92 is rotated together with the connection portion 911 to drive rotation of the one of the lifting units 7, thereby driving the linkage unit 8 to synchronize the movement of the lifting units 7. As such, the working platform unit 5 is stably moved along the slide rails 6.

Figure 2:
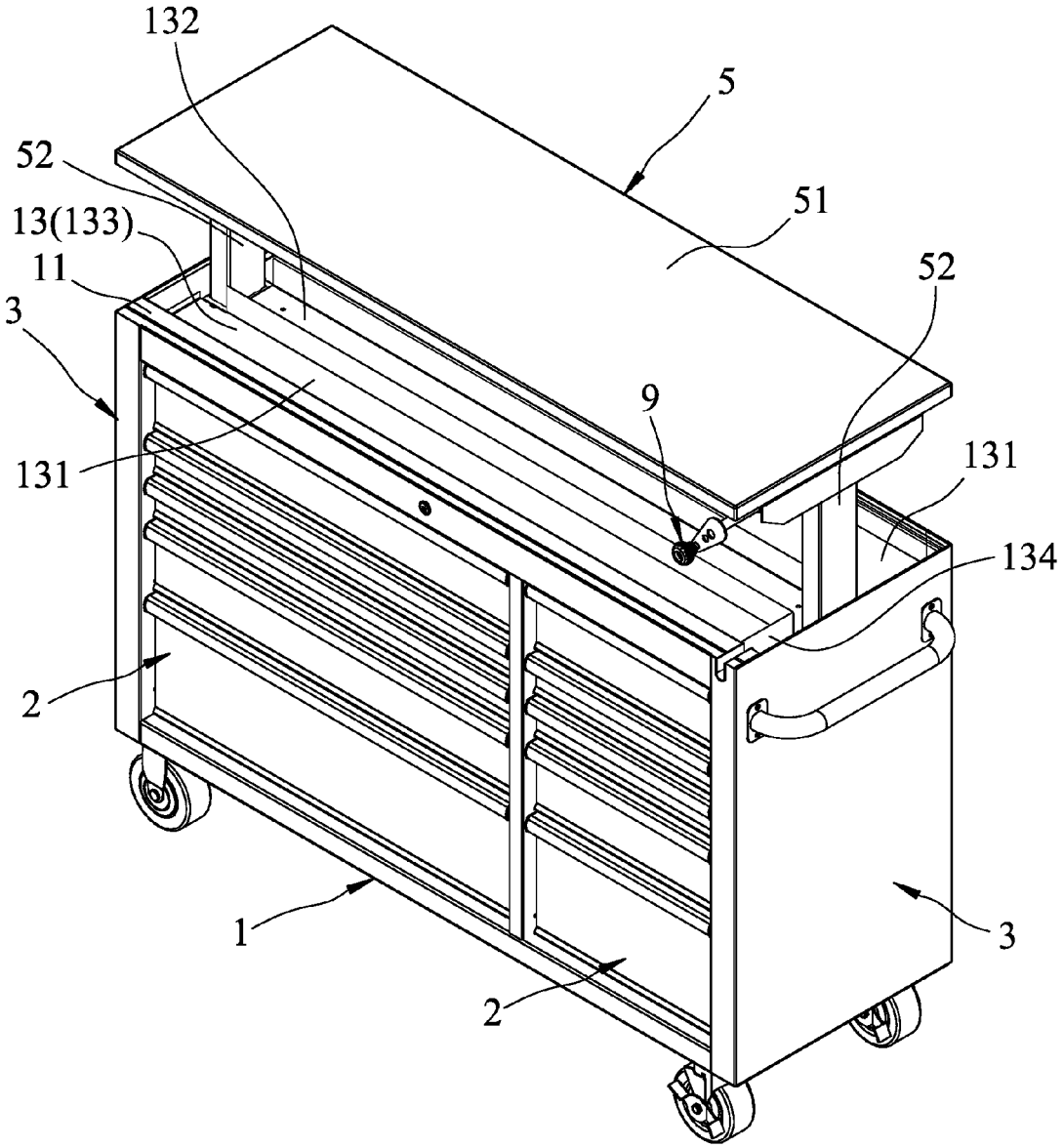
FIG. 2 is an assembled perspective view of the embodiment, illustrating a working platform unit when lifted upward from a top cover.
Figure 6:
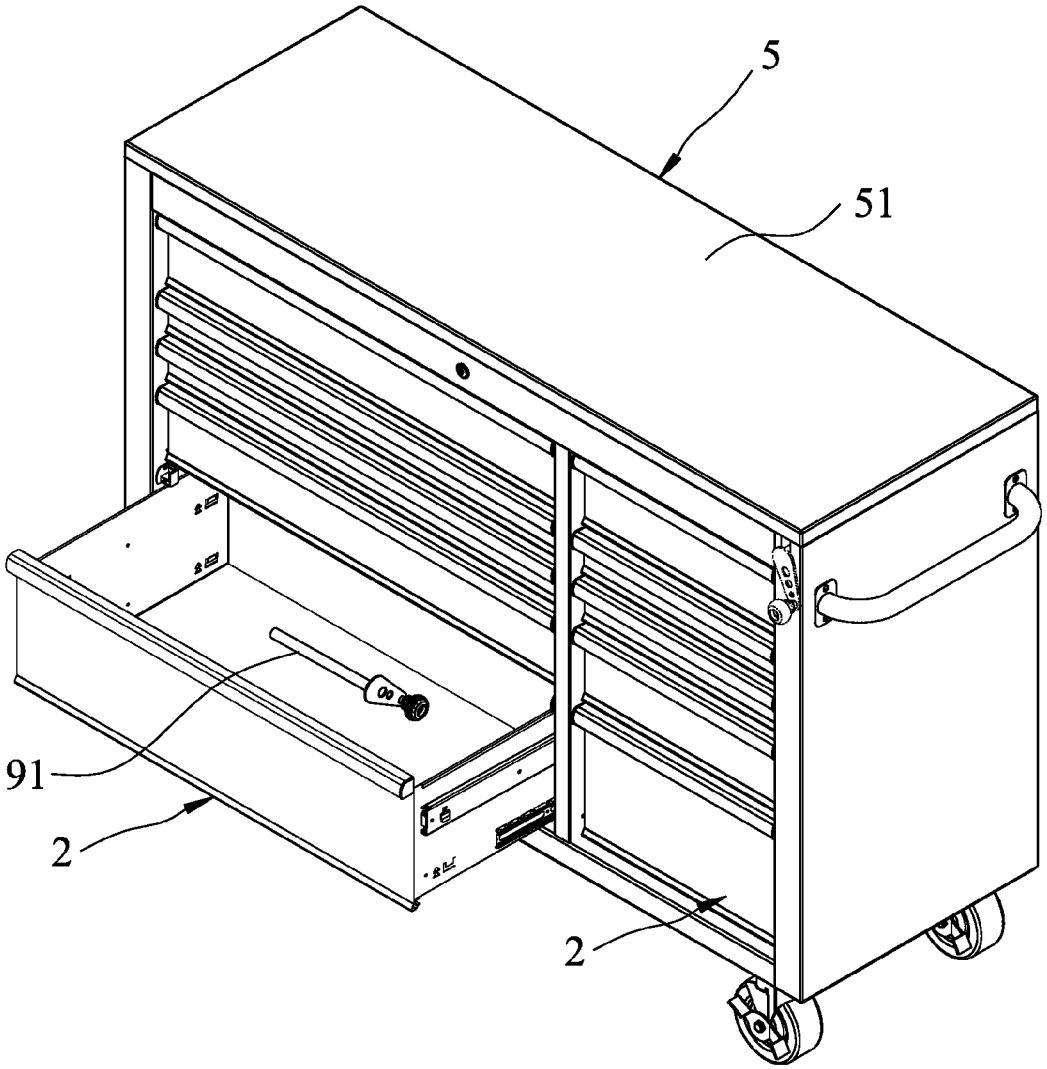
FIG. 6 is a perspective view of the embodiment, illustrating an opened drawer and a crank member of the drive unit stored in the drawer.

Referring to FIGS. 2 and 6, the working platform unit 5 is movable along the slide rails 6 between a lowered position (see FIG. 6), where the platform member 51 is adjacent to the cabinet housing 1 and closes the storage groove 13, and a lifted position (see FIG. 2), where the platform member 51 is away from the cabinet housing 1. When the working platform unit 5 is at the lifted position, additional tools can be conveniently stored in the storage groove 13 if the drawers 2 are full. In addition, the other one of the main storage sections 131 of the storage groove 13 has a width larger than that of the drawers 2 (see FIG. 1), so that tools of relatively large sizes can be stored, which enhances the flexibility in use. Moreover, tools that are to be used can be taken out from the drawers 2 and temporarily placed in the storage groove 13 for the user's easy access. Referring further to FIG. 5, when the working platform unit 5 is at the lowered position, the linkage unit 8 is received in the intermediate groove section 132 of the storage groove 13, and the second storage subsection 134 of the one of the main storage groove sections 131 receives the rotatable connection portion 911 of the crank member 91. At this time, the crank member 91 can be removed from the engaging segment 522 of the drive bevel gear 92 and stored in any one of the drawers 2, thereby preventing movement of the working platform unit 5 from the lowered position to the lifted position and theft of the tools stored in the storage groove 13.

It should be noted that, the slide rails 6 also serve to reinforce the structural strength of the opposite sides of the cabinet housing 1.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A tool cabinet comprising:

a cabinet housing that includes a top cover, said top cover having a top surface that is formed with a storage groove;

a plurality of drawers that are movably disposed in said cabinet housing;

a working platform unit that has a platform member disposed above said top cover, and two extension members extending respectively and downwardly from two opposite ends of said platform member through said top cover;

two slide rails that are respectively disposed at opposite sides of said cabinet housing, said extension members engaging respectively and slidably said slide rails;

two lifting units that are respectively and movably disposed at the opposite sides of said cabinet housing, and that are connected to said working platform unit;

a linkage unit that interconnects said lifting units and that synchronizes movement of said lifting units; and a drive unit that is drivingly connected to one of said lifting units, and that is operable to drive synchronized movements of said lifting units to move said working platform unit along said slide rails between a lowered position, where said platform member is adjacent to said cabinet housing and closes said storage groove, and a lifted position, where said platform member is away from said cabinet housing;

wherein each of said lifting units has a guide tube that is disposed in a respective one of said slide rails, a nut that is disposed on a top end of said guide tube, a threaded rod that is threadedly connected to said nut and that has a top end adjacent to said platform member and an opposite end inserted telescopically into said guide tube, and a transmission bevel gear that is fixedly disposed on said top end of said threaded rod;

wherein said linkage unit includes a linkage rod that is disposed below said platform member, that extends along a horizontal axis, and that is rotatable about the horizontal axis, and two linkage bevel gears that are respectively connected to two opposite ends of said linkage rod and that respectively mesh with said transmission bevel gears of said lifting units;

wherein said drive unit includes a crank member that is mounted to said working platform unit and that is connected to said transmission bevel gear of the one of said lifting units;

wherein said drive unit further includes a drive bevel gear that is connected to said crank member and that meshes with said transmission bevel gear of the one of said lifting units;

wherein said crank member has a rotatable connection portion that is mounted to said working platform unit and that has an end connected to said drive bevel gear, and a handle portion that is connected to said connection portion and that is opposite to said drive bevel gear;

wherein said rotatable connection portion of said crank member has an engaging space; and wherein said drive bevel gear of said crank member has a main gear segment that meshes with said transmission bevel gear of the one of said lifting units, and an engaging segment that is connected co-axially to said main gear segment and that engages removably, fittingly and co-rotatably said engaging space of said rotatable connection portion.

2. The tool cabinet as claimed in claim 1, wherein said drawers are arranged in two parallel rows.

3. The tool cabinet as claimed in claim 2, wherein said cabinet housing further includes two border plates disposed in said storage groove and dividing said storage groove into two main storage groove sections and an intermediate groove section that is disposed between said main storage groove sections and that receives said linkage unit when said working platform unit is at the lowered position.

4. The tool cabinet as claimed in claim 2, wherein:

each of said extension members has a main portion that extends downwardly from a respective one of the two opposite ends of said platform member, and an engaging portion that surrounds and protrudes from a bottom end of said main portion; and each of said slide rails has a slide portion that has an inner surface surrounding said main portion of a respective one of said extension members, and an abutment portion that is connected to a top end of said slide portion, that surrounds and abuts against said main portion of the respective one of said extension members, and that retains said engaging portion of the respective one of extension members within said slide portion.

5. The tool cabinet as claimed in claim 4, wherein:

said top cover has an end-defining surface that defines a bottom end of said storage groove and that is formed with two through holes; and said abutment portions of said slide rails are respectively disposed in said through holes and are flush with said end-defining surface.

6. The tool cabinet as claimed in claim 1, wherein:

said linkage unit is disposed under said platform member; and said cabinet housing further includes a dividing plate disposed in said storage groove, and connected perpendicularly to one of said border plates for dividing a corresponding one of said main storage groove sections into a first storage subsection, and a second storage subsection that receives said rotatable connection portion of said crank member when said working platform unit is at the lowered position.

* * * * *